US008778459B2

(12) United States Patent
Farmer et al.

(10) Patent No.: US 8,778,459 B2
(45) Date of Patent: Jul. 15, 2014

(54) CORROSION RESISTANT AMORPHOUS METALS AND METHODS OF FORMING CORROSION RESISTANT AMORPHOUS METALS

(75) Inventors: Joseph C. Farmer, Tracy, CA (US); Frank M. G. Wong, Livermore, CA (US); Jeffery J. Haslam, Livermore, CA (US); Nancy Yang, Lafayette, CA (US); Enrique J. Lavernia, Davis, CA (US); Craig A. Blue, Knoxville, TN (US); Olivia A. Graeve, Reno, NV (US); Robert Bayles, Annandale, VA (US); John H. Perepezko, Madison, WI (US); Larry Kaufman, Brookline, MA (US); Julie Schoenung, Davis, CA (US); Leo Ajdelsztajn, Walnut Creek, CA (US)

(73) Assignees: Lawrence Livermore National Security, LLC., Livermore, CA (US); The Regents of the University of California, Oakland, CA (US); Sandia Corporation, Albuquerque, NM (US)

( * ) Notice: Subject to any disclaimer, the term of this patent is extended or adjusted under 35 U.S.C. 154(b) by 693 days.

(21) Appl. No.: 12/571,535

(22) Filed: Oct. 1, 2009

(65) Prior Publication Data

US 2010/0028550 A1 Feb. 4, 2010

Related U.S. Application Data

(63) Continuation of application No. 11/595,676, filed on Nov. 9, 2006, now Pat. No. 7,618,500.

(60) Provisional application No. 60/736,792, filed on Nov. 14, 2005.

(51) Int. Cl.
*C23C 4/08* (2006.01)
*B05D 1/34* (2006.01)

(52) U.S. Cl.
USPC ..... 427/456; 427/455; 427/186

(58) Field of Classification Search
None
See application file for complete search history.

(56) References Cited

U.S. PATENT DOCUMENTS 4,770,701 A * 9/1988 Henderson et al. ..... 75/232
4,880,482 A 11/1989 Hashimoto et al.

(Continued)

FOREIGN PATENT DOCUMENTS

EP 1 036 857 A1 10/2000
GB 867 455 A 5/1961

(Continued)

OTHER PUBLICATIONS

Farmer et al, Corrosion Characterization of Iron-Based High-Performance Amorphous-Metal Thermal-Spray Coatings, ASME Pressure Vessels & Piping Division Conference (2005).*

(Continued)

*Primary Examiner* — Yoshitoshi Takeuchi
(74) *Attorney, Agent, or Firm* — Eddie E. Scott

(57) ABSTRACT

A system for coating a surface comprises providing a source of amorphous metal, providing ceramic particles, and applying the amorphous metal and the ceramic particles to the surface by a spray. The coating comprises a composite material made of amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %).

5 Claims, 6 Drawing Sheets

(56) References Cited

U.S. PATENT DOCUMENTS

| | | | | |
|---|---|---|---|---|
| 5,486,240 | A | 1/1996 | McCallum et al. | |
| 5,626,691 | A | 5/1997 | Li et al. | |
| 5,690,889 | A | 11/1997 | McCallum et al. | |
| 5,803,992 | A | 9/1998 | McCallum et al. | |
| 6,125,912 | A | 10/2000 | Branagan et al. | |
| 6,258,185 | B1 | 7/2001 | Branagan et al. | |
| 6,261,386 | B1 | 7/2001 | Perepezko et al. | |
| 6,562,156 | B2 | 5/2003 | Liu | |
| 6,706,319 | B2 * | 3/2004 | Seth et al. | 427/190 |
| 6,767,419 | B1 | 7/2004 | Branagan | |
| 2003/0051781 | A1 | 3/2003 | Branagan | |
| 2003/0164209 | A1 | 9/2003 | Poon et al. | |
| 2004/0140017 | A1 | 7/2004 | Branagan | |
| 2004/0140021 | A1 | 7/2004 | Branagan | |
| 2004/0250926 | A1 | 12/2004 | Branagan | |
| 2004/0250929 | A1 | 12/2004 | Branagan | |
| 2004/0253381 | A1 | 12/2004 | Branagan | |
| 2005/0013723 | A1 | 1/2005 | Branagan | |
| 2005/0084421 | A1 | 4/2005 | Unger et al. | |
| 2005/0129581 | A1 | 6/2005 | McBride et al. | |
| 2005/0252773 | A1 | 11/2005 | McBride et al. | |

FOREIGN PATENT DOCUMENTS

| | | | |
|---|---|---|---|
| JP | 03 140450 | A | 6/1991 |
| JP | 05 195107 | A | 8/1993 |
| KR | 2004 070 447 | A | 8/2004 |
| WO | WO 2005/024075 | * | 3/2005 |
| WO | WO 2005/024075 | A2 | 3/2005 |

OTHER PUBLICATIONS

Farmer et al, High-Performance Corrosion-Resistant Iron-based Amorphous Metals—The Effects of Composition, Structure and Environment: Fe49.7Cr17.7Mn1.9Mo7.4W1.6B15.2C3.8Si2.4, Materials Research Society Fall Meeting 2006 (2006).*

Davis ed., Handbook of Thermal Spray Technology, 77-84 (2004).*

Patil, U. et al, "An unusual phase transformation during mechanical alloying of a Fe-bsed bulk metallic glass composition," Journal of Alloys and Compounds 389 (2005) 121-126.

Wang, W.H., et al., "Enhancement of the soft magnetic properties of FeCoZrMoWB bulk metallic glass by microalloying," J. Phys.: Conden.Matter 16 (2004) 3719-3723.

Shen, J. et al., "Exceptionally high glass-forming ability of an FeCoCrMoCBY alloy," Applied Physics Letters 86, (2005) 151907-1-3.

Chen, Q.J. et al., "Glass-Forming Ability of an Iron-Based Alloy Enhanced by Co Addition and Evaluated by a New Criterion," Chin. Phys. Lett., vol. 22, No. 7 (2005) 1736-1738.

Lin, C.Y., et al., "Soft magnetic ternary iron-boron-based bulk metallic glasses," Applied Physics Letters 86, (2005), 162501-1-3.

Hu, Y,, et al., "Synthesis of Fe-based bulk metallic glasses with low purity materials by multi-metalloids addition," Materials Letters 57, (2003) , 2698-2701.

* cited by examiner

CORROSION RESISTANT AMORPHOUS METALS AND METHODS OF FORMING CORROSION RESISTANT AMORPHOUS METALS

CROSS-REFERENCE TO RELATED APPLICATIONS

This application is a Continuation of application Ser. No. 11/595,676 filed Nov. 9, 2006 now U.S. Pat. No. 7,618,500 and titled "Corrosion Resistant Amorphous Metals and Methods of Forming Corrosion Resistant Amorphous Metals, which claims the benefit of U.S. Provisional Patent Application No. 60/736,792 filed Nov. 14, 2005 and titled "Corrosion Resistant Amorphous Metal and Ceramic Particle System." U.S. Provisional Patent Application No. 60/36,792 filed Nov. 14, 2005 and titled "Corrosion Resistant Amorphous Metal and Ceramic Particle System" is incorporated herein by this reference.

STATEMENT AS TO RIGHTS TO INVENTIONS MADE UNDER FEDERALLY SPONSORED RESEARCH AND DEVELOPMENT

The United States Government has rights in this invention pursuant to Contract No. DE-AC52-07NA27344 between the United States Department of Energy and Lawrence Livermore National Security, LLC for the operation of Lawrence Livermore National Laboratory.

BACKGROUND

1. Field of Endeavor

The present invention relates to corrosion resistant materials and more particularly to corrosion resistant amorphous materials and methods of forming corrosion resistant amorphous materials.

2. State of Technology

U.S. Pat. No. 6,767,419 for methods of forming hardened surfaces issued Jul. 27, 2004 to Daniel Branagan and assigned to Bechtel BWXT Idaho, LLC, provides the following state of technology information, "Both microcrystalline grain internal structures and metallic glass internal structures can have properties which are desirable in particular applications for steel. In some applications, the amorphous character of metallic glass can provide desired properties. For instance, some glasses can have exceptionally high strength and hardness. In other applications, the particular properties of microcrystalline grain structures are preferred. Frequently, if the properties of a grain structure are preferred, such properties will be improved by decreasing the grain size. For instance, desired properties of microcrystalline grains (i.e., grains having a size on the order of $10^{-6}$ meters) can frequently be improved by reducing the grain size to that of nanocrystalline grains (i.e., grains having a size on the order of $10^{-9}$ meters). It is generally more problematic to form grains of nanocrystalline grain size than it is to form grains of microcrystalline grain size. Accordingly, it is desirable to develop improved methods for forming nanocrystalline grain size steel materials. Further, as it is frequently desired to have metallic glass structures, it is desirable to develop methods of forming metallic glasses."

United States Patent Application No. 2003/0051781 for hard metallic materials, hard metallic coatings, methods of processing metallic materials and methods of producing metallic coatings by Daniel J. Branagan published Mar. 20, 2003 provides the following state of technology information, "Both microcrystalline grain internal structures and metallic glass internal structures can have properties which are desirable in particular applications for steel. In some applications, the amorphous character of metallic glass can provide desired properties. For instance, some glasses can have exceptionally high strength and hardness. In other applications, the particular properties of microcrystalline grain structures are preferred. Frequently, if the properties of a grain structure are preferred, such properties will be improved by decreasing the grain size. For instance, desired properties of microcrystalline grains (i.e., grains having a size on the order of $10^{-6}$ meters) can frequently be improved by reducing the grain size to that of nanocrystalline grains (i.e., grains having a size on the order of $10^{-9}$ meters). It is generally more problematic, and not generally possible utilizing conventional approaches, to form grains of nanocrystalline grain size than it is to form grains of microcrystalline grain size."

SUMMARY

Features and advantages of the present invention will become apparent from the following description. Applicants are providing this description, which includes drawings and examples of specific embodiments, to give a broad representation of the invention. Various changes and modifications within the spirit and scope of the invention will become apparent to those skilled in the art from this description and by practice of the invention. The scope of the invention is not intended to be limited to the particular forms disclosed and the invention covers all modifications, equivalents, and alternatives falling within the spirit and scope of the invention as defined by the claims.

The present invention provides a method of coating a surface comprising the steps of providing a source of amorphous metal, providing ceramic particles, and applying the amorphous metal and the ceramic particles to the surface by a spray. The amorphous metal is Fe-based, Ni-based, Cu-based, Al-based, or Zr-based amorphous metal. The ceramic particles have a size within the range of nanometers to microns.

In one embodiment of the present invention the amorphous metal includes yttrium (≥1 atomic %), chromium (14 to 18 atomic %), molybdenum (≥7 atomic %), tungsten (≥1 atomic %), boron (≤5 atomic %), and carbon (≥4 atomic %). In one embodiment of the present invention the ceramic particles have a size within the range of 5 nanometers to 5 microns. In one embodiment of the present invention the step of applying the amorphous metal and the ceramic particles to the surface by a spray comprises spraying alternating layers to the surface wherein at least one of the alternating layers contains amorphous metal including yttrium (≥1 atomic %), chromium (14 to 18 atomic %), molybdenum (≥7 atomic %), tungsten (≥1 atomic %), boron (≤5 atomic %), carbon (≥4 atomic %) and ceramic particles having a size with the range of nanometers to microns.

In another embodiment of the present invention the amorphous metal includes yttrium, chromium, molybdenum, tungsten, boron, and carbon, at any composition where glass formation can occur. In this embodiment of the present invention the ceramic particles have a size within the range of 5 nanometers to 5 microns.

In yet another embodiment of the present invention, a metal-ceramic composite coating consisting of a homogenous mixture of ceramic particles and an amorphous-metal binder, with an appropriate bonding or transition layer is envisioned.

In yet another embodiment of the present invention, a metal-ceramic composite coating consisting of a homogeneous mixture of amorphous metal particles and a soft metal binder, sufficiently soft to enable application with cold spray technology, with an appropriate bonding or transition layer is envisioned.

In yet another embodiment of the present invention the step of applying the amorphous metal and the ceramic particles to the surface by a spray comprises spraying alternating layers to the surface wherein at least one of the alternating layers contains amorphous metal including yttrium, chromium, molybdenum, tungsten, boron, and carbon, and ceramic particles having a size with the range of nanometers to microns, as shown in FIGS. 2 through 6.

The present invention also provides a coating comprising a composite material made of amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles. In one embodiment of the present invention the amorphous metal and ceramic particles form a layered metal-ceramic composite material with alternating layers of amorphous metal and ceramic particles. In one embodiment of the present invention the amorphous metal and ceramic particles form a layered metal-ceramic composite material with alternating layers of amorphous metal and ceramic particles and wherein there are interfaces between the layers with sharp changes in composition at the interfaces. In one embodiment of the present invention the amorphous metal and ceramic particles form a layered metal-ceramic composite material with alternating layers of amorphous metal and ceramic particles and wherein there are interfaces between the layers with compositional gradients at the interfaces.

The present invention also provides a coating comprising a composite material made of amorphous metal that contains one or more of the following elements in any range of composition that yields an amorphous metal: yttrium, chromium, molybdenum, tungsten, boron or carbon, and ceramic particles. In one embodiment of the present invention the amorphous metal and ceramic particles form a layered metal-ceramic composite material with alternating layers of amorphous metal and ceramic particles. In one embodiment of the present invention the amorphous metal and ceramic particles form a layered metal-ceramic composite material with alternating layers of amorphous metal and ceramic particles and wherein there are interfaces between the layers with sharp changes in composition at the interfaces. In one embodiment of the present invention the amorphous metal and ceramic particles form a layered metal-ceramic composite material with alternating layers of amorphous metal and ceramic particles and wherein there are interfaces between the layers with compositional gradients at the interfaces.

The invention is susceptible to modifications and alternative forms. Specific embodiments are shown by way of example. It is to be understood that the invention is not limited to the particular forms disclosed. The invention covers all modifications, equivalents, and alternatives falling within the spirit and scope of the invention as defined by the claims.

BRIEF DESCRIPTION OF THE DRAWINGS

The accompanying drawings, which are incorporated into and constitute a part of the specification, illustrate specific embodiments of the invention and, together with the general description of the invention given above, and the detailed description of the specific embodiments, serve to explain the principles of the invention.

DETAILED DESCRIPTION OF THE INVENTION

Figure 1A:
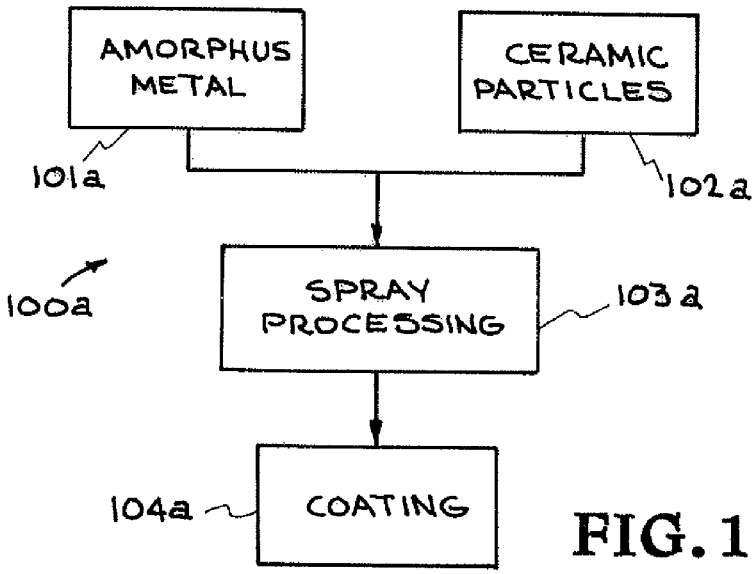
FIG. 1A illustrates a system wherein an amorphous metal and ceramic particles are used in a spray process to form a coating.

Referring to the drawings, to the following detailed description, and to incorporated materials, detailed information about the invention is provided including the description of specific embodiments. The detailed description serves to explain the principles of the invention. The invention is susceptible to modifications and alternative forms. The invention is not limited to the particular forms disclosed. The invention covers all modifications, equivalents, and alternatives falling within the spirit and scope of the invention as defined by the claims.

Referring now to the drawings and in particular to FIG. 1A, one embodiment of a system incorporating the present invention is illustrated. This embodiment is designated generally by the reference numeral 100A. The embodiment 100A provides a corrosion resistant amorphous metal-ceramic coating. The corrosion resistant amorphous metal-ceramic coating is produced by spray processing to form a composite material made of amorphous metal and ceramic particles. The performance of the thermal spray coating of amorphous metal is enhanced by including particles of oxide, carbide, boride, or nitride particles and/or nanoparticles. These particles improve the hardness and wear resistance of the thermal-spray coating. In some cases, the ceramic particles in the corrosion-resistant amorphous-metal binder phase forms a coating system wherein fracture is mitigated by the interruption of propagating shear bands and fractures in the amorphous metal, thereby lowering the overall susceptibility to fracture. The particles also increase the functionality of amorphous metal coatings. For example, the inclusion of boride particles in thermal spray coatings of amorphous metals can increase the neutron absorption cross-section of such coatings, thereby making them more desirable for criticality control applications (nuclear criticality) than would be possible with a simple amorphous metal.

As illustrated in FIG. 1A, an amorphous metal 101A and ceramic particles 102A are used in a spray process 103A to form a coating 104A. The coating 104A has many uses. For example, the coating 104A has application on ships; oil, gas, and water drilling equipment; earth moving equipment; tunnel-boring machinery; pump impellers and shafts; containers for shipment, storage and disposal of spent nuclear fuel; pressurized water and boiling water nuclear reactors; breeder reactors with liquid metal coolant; metal-ceramic armor; projectiles; gun barrels; tank loader trays; rail guns; non-magnetic hulls; hatches; seals; propellers; rudders; planes; and any other use where corrosion resistance is needed.

Figure 1B:
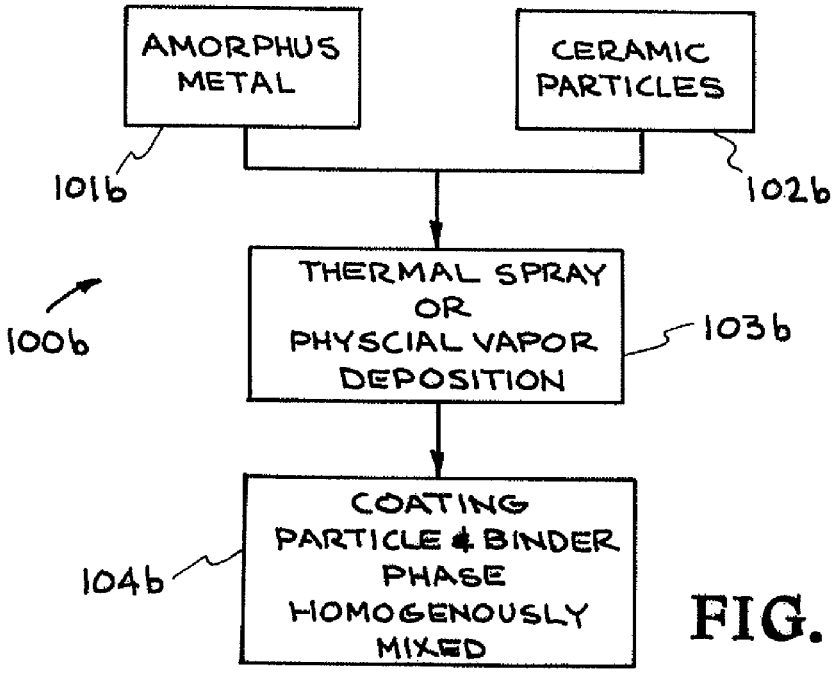
FIG. 1B illustrates a metal-ceramic composite coating with ceramic particles and amorphous-metal binder, with thermal spray deposition or physical vapor deposition. The particles and binder phase are homogenously mixed.
Figure 1C:
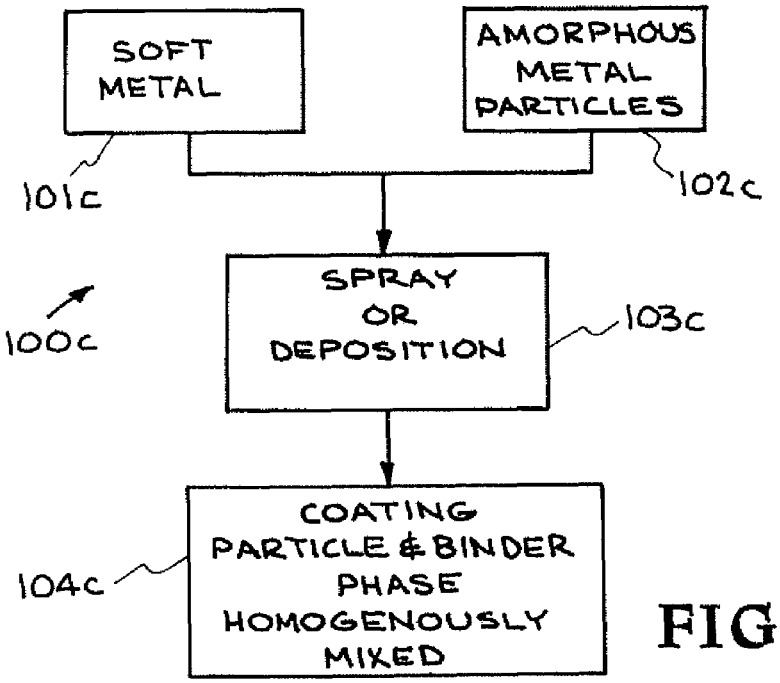
FIG. 1C illustrates a metal-ceramic composite coating with amorphous metal particles and soft metal binder, with cold spray, thermal spray, physical vapor or electrolytic deposition. The particles and binder phase are homogeneously mixed in this case.
Figure 1D:
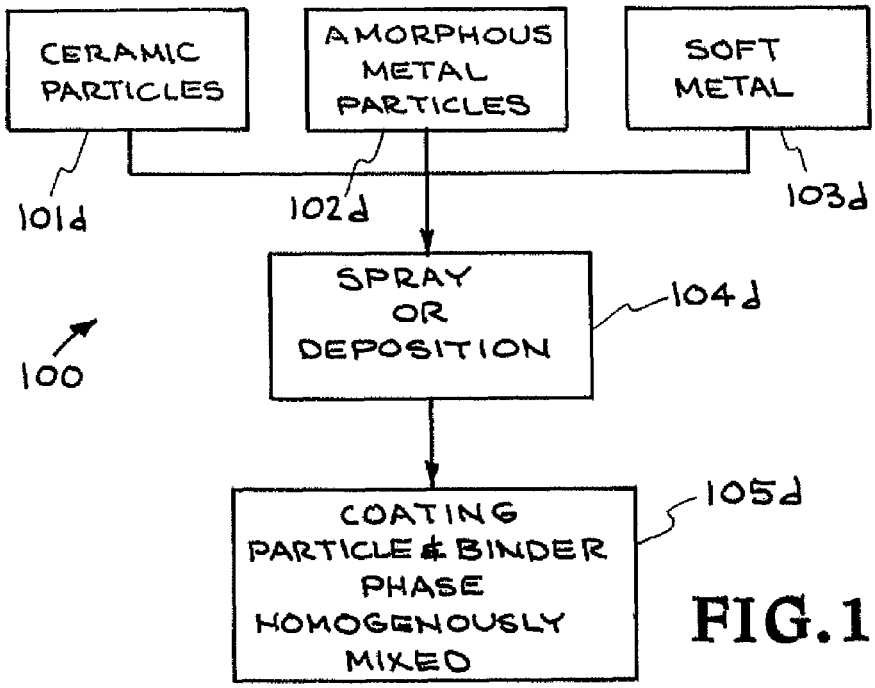
FIG. 1D illustrates a metal-ceramic composite coating with ceramic particles, amorphous metal particles, and a soft metal binder with cold spray, thermal spray, physical vapor or electrolytic deposition. The particles and binder phase are homogeneously mixed in this case.

As illustrated in FIGS. 1B through 1D, there are several other variants of the coating, with similar applications. Depending upon the binder phase, these metal-ceramic coatings can be produced by thermal spray, cold spray, or other deposition processes.

Referring now to FIG. 1B, another embodiment of a system incorporating the present invention is illustrated. This embodiment is designated generally by the reference numeral 100B. An amorphous metal 101B and ceramic particles 102B are used in a process 103B to form a coating 104B. The system 100B provides a metal-ceramic composite coating with ceramic particles and amorphous-metal binder, with thermal spray deposition or physical vapor deposition. The amorphous metal 101B and ceramic particles 102B are used in a thermal spray or physical vapor deposition 103B. The thermal spray or physical vapor deposition 103B provides the coating 104B. In the coating 104B, the ceramic particles and binder phase are homogenously mixed. The coating 104B has application on ships; oil, gas, and water drilling equipment; earth moving equipment; tunnel-boring machinery; pump impellers and shafts; containers for shipment, storage and disposal of spent nuclear fuel; pressurized water and boiling water nuclear reactors; breeder reactors with liquid metal coolant; metal-ceramic armor; projectiles; gun barrels; tank loader trays; rail guns; non-magnetic hulls; hatches; seals; propellers; rudders; planes; and any other use where corrosion resistance is needed.

Referring now to FIG. 1C, yet another embodiment of a system incorporating the present invention is illustrated. This embodiment is designated generally by the reference numeral 100C. Soft metal 101C and amorphous metal particles 102C are used in a process 103C to form a coating 104C. The system 100C provides a metal-particle composite coating with amorphous metal particles and soft metal binder, with cold spray, thermal spray, physical vapor or electrolytic deposition. The soft metal 101C and amorphous metal particles 102C are used in a cold spray, thermal spray, physical vapor or electrolytic deposition 103C. The cold spray, thermal spray, physical vapor or electrolytic deposition 103C provides the coating 104C. In the coating 104C, the amorphous metal particles and binder phase are homogenously mixed. The coating 104C has application on ships; oil, gas, and water drilling equipment; earth moving equipment; tunnel-boring machinery; pump impellers and shafts; containers for shipment, storage and disposal of spent nuclear fuel; pressurized water and boiling water nuclear reactors; breeder reactors with liquid metal coolant; metal-ceramic armor; projectiles; gun barrels; tank loader trays; rail guns; non-magnetic hulls; hatches; seals; propellers; rudders; planes; and any other use where corrosion resistance is needed.

Referring now to FIG. 1D, another embodiment of a system incorporating the present invention is illustrated. This embodiment is designated generally by the reference numeral 100D. Ceramic particles 101D, amorphous metal particles 102D, and soft metal 103D are used in a process 104D to form a coating 105D. The system 100D provides a metal-particle composite coating with ceramic particles, amorphous metal particles, and soft metal binder, with cold spray, thermal spray, physical vapor or electrolytic deposition. The ceramic particles 101D, amorphous metal particles 102D, and soft metal 103D are used in a cold spray, thermal spray, physical vapor or electrolytic deposition 104D. The cold spray, thermal spray, physical vapor or electrolytic deposition 104D provides the coating 105D. In the coating 105D, the ceramic particles and amorphous metal particles and binder phase are homogenously mixed. The coating 105C has application on ships; oil, gas, and water drilling equipment; tunnel-boring machinery; pump impellers and shafts; containers for shipment, storage and disposal of spent nuclear fuel; pressurized water and boiling water nuclear reactors; breeder reactors with liquid metal coolant; metal-ceramic armor; projectiles; gun barrels; tank loader trays; rail guns; non-magnetic hulls; hatches; seals; propellers; rudders; planes; and any other use where corrosion resistance is needed.

Figure 1E:
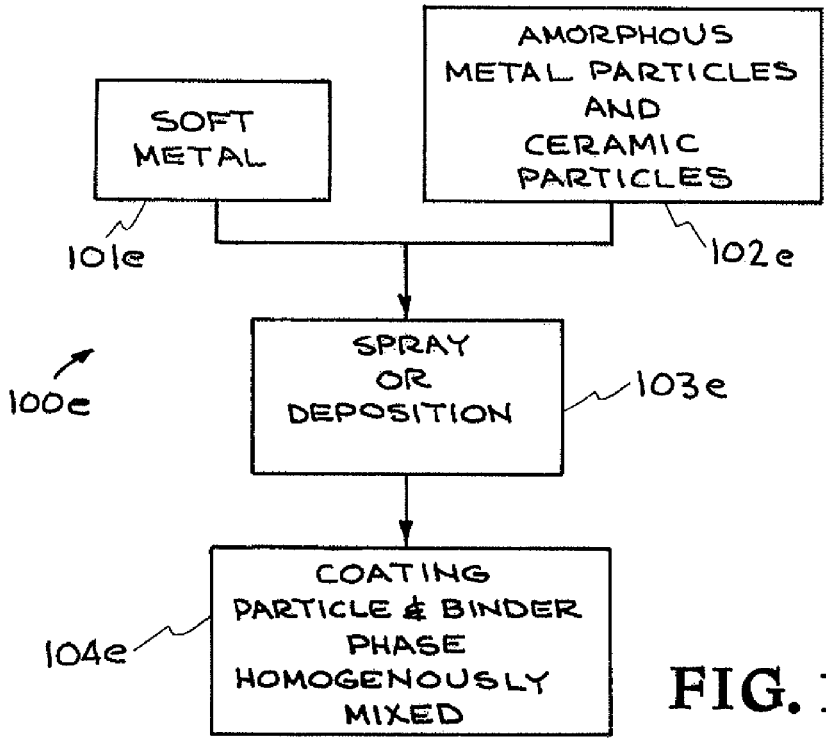
FIG. 1E illustrates a metal-ceramic composite coating with both ceramic and amorphous metal particles and a soft metal binder, with cold spray, thermal spray, physical vapor or electrolytic deposition. The particles and binder phase are homogeneously mixed in this case.

Referring now to FIG. 1E, another embodiment of a system incorporating the present invention is illustrated. This embodiment is designated generally by the reference numeral 100E. A source of soft metal 101E and a source of amorphous metal particles and ceramic particles 102E are used in a process 100E to form a coating 104E. The system 100E provides a metal-particle composite coating with ceramic particles, amorphous metal particles, and soft metal binder, with cold spray, thermal spray, physical vapor or electrolytic deposition. The amorphous metal particles and ceramic particles 102E and soft metal 101E are used in a cold spray, thermal spray, physical vapor or electrolytic deposition 103E. The cold spray, thermal spray, physical vapor or electrolytic deposition 103E provides the coating 104E. In the coating 104E, the ceramic particles and amorphous metal particles and binder phase are homogenously mixed. The coating 104C has application on ships; oil, gas, and water drilling equipment; earth moving equipment; tunnel-boring machinery; pump impellers and shafts; containers for shipment, storage and disposal of spent nuclear fuel; pressurized water and boiling water nuclear reactors; breeder reactors with liquid metal coolant; metal-ceramic armor; projectiles; gun barrels; tank loader trays; rail guns; non-magnetic hulls; hatches; seals; propellers; rudders; planes; and any other use where corrosion resistance is needed.

Corrosion costs the nation billions of dollars every year, with an immense quantity of material in various structures undergoing corrosion. For example, in addition to fluid and seawater piping, ballast tanks, and propulsions systems, approximately 345 million square feet of structure aboard naval ships and crafts require costly corrosion control measures. The use of the corrosion resistant amorphous metal-ceramic coating of the present invention to prevent the continuous degradation of this massive surface area would be extremely beneficial.

The corrosion resistant amorphous metal-ceramic coating of the present invention could also be used to coat the entire outer surface of containers for the transportation and long-term storage of high-level radioactive waste (HLW) spent nuclear fuel (SNF), or to protect welds and heat affected zones, thereby preventing exposure to environments that might cause stress corrosion cracking. In the future, it may be possible to substitute such high-performance iron-based materials for more-expensive nickel-based alloys, thereby enabling cost savings in various industrial applications.

The coating is formed by spray or deposition processing as illustrated in FIGS. 1A, 1B, 1C and 1D. The spray processing can be thermal spray processing or cold spray processing. Different spray processing can be used to form the coating; for example, the spray processing can be flame spray processing, plasma spray processing, high-velocity oxy-fuel (HVOF) spray processing, high-velocity air-spray (HVAF) processing, or detonation gun processing. Physical vapor or electrolytic deposition can be used to form the coating.

Figure 2:
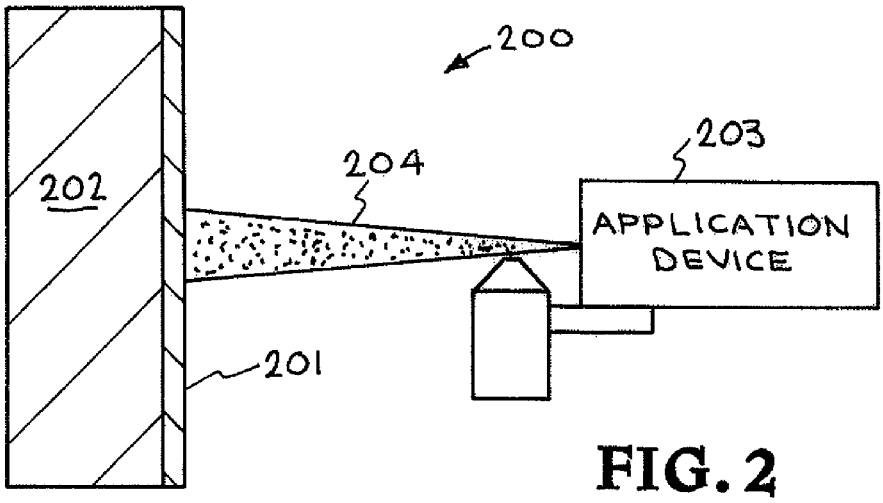
FIG. 2 illustrates a system wherein at least one layer of amorphous metal and ceramic particles is used in a spray process to form a coating.

Referring now to FIG. 2, another embodiment of a system incorporating the present invention is illustrated. This embodiment is designated generally by the reference numeral 200. In this embodiment a coating is formed by spray processing. At least one layer with particles in a metal binder is formed by an application process to form a coating. As illustrated in FIG. 2, a coating layer 201 is shown being applied to a structure 202. An application device 203 is shown applying a spray 204 onto the structure 202. A metal binder and particles are used in the process 200 to form the coating 201. The system 200 provides a composite coating with particles in a metal binder, with spray deposition or physical vapor deposition. The metal and particles are used in the thermal spray or physical vapor deposition system 203. The thermal spray or physical vapor deposition system 203 provides the coating 201. In the coating 201, the particles and binder phase are homogenously mixed. Different processing systems can be used to form the coating; for example, the spray processing can be flame spray processing, plasma spray processing, high-velocity oxy-fuel (HVOF) spray processing, high-velocity air-spray (HVAF) processing, or detonation gun processing. The spray processing can be thermal spray processing or cold spray processing. The application system 203 can also be a deposition system.

Figure 3:
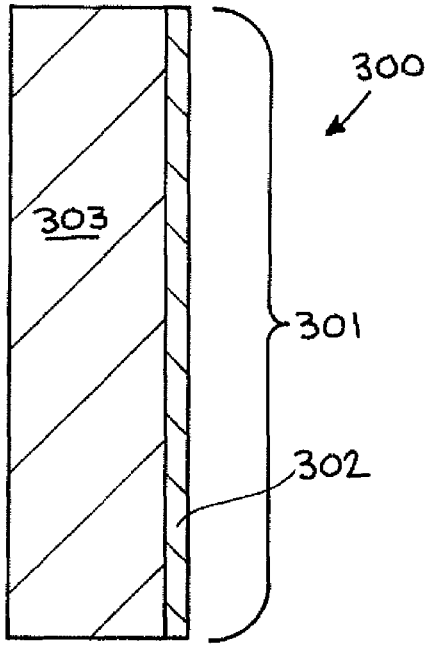
FIG. 3 illustrates an embodiment of spray processing that forms alternating layers of a coating wherein the alternate layers comprise amorphous metal and ceramic particles.

Referring again to the drawings and in particular to FIG. 3, another embodiment of the present invention is illustrated. The embodiment illustrates a system for producing a corrosion resistant amorphous metal-ceramic coating constructed according to the present invention. This embodiment of a coating system is designated generally by the reference numeral 300. In the system 300, a corrosion resistant amorphous metal-ceramic coating 301 is produced by spray processing to form a composite material made of amorphous metal and ceramic particles 302. The coating 301 has been applied to a structure 303. In the coating 301, the ceramic particles 302 and binder phase are homogenously mixed.

Figure 4:
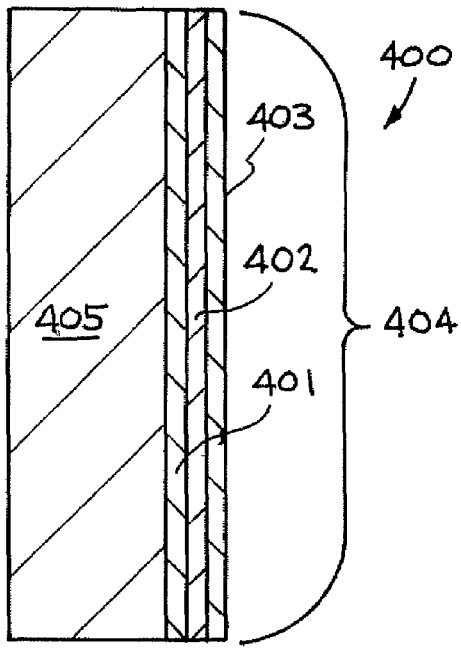
FIG. 4 illustrates another embodiment of spray processing that forms alternating layers of a coating wherein the alternate layers comprise amorphous metal and ceramic particles.

Referring again to the drawings and in particular to FIG. 4, another embodiment of the present invention is illustrated. The embodiment illustrates a system for producing a corrosion resistant coating constructed according to the present invention. This embodiment of a coating system is a "compositionally graded coating" with a multiplicity of layers. The overall coating system is designated generally by the reference numeral 400 and the coating is designated generally by the reference numeral 404. The specific coating 404 that is illustrated is a "compositionally graded coating" with an outer surface that is predominantly ceramic.

In the system 400, a multi-layer corrosion resistant coating 404 is produced by spray processing. The spray processing forms a multiplicity of layers 401, 402, and 403 of the coating 404. The layers 401, 402, and 403 comprise amorphous metal and ceramic particles. As illustrated in FIG. 4, the layers 401, 402, and 403 are applied to a structure 405. The layer 401 has a composition that is primarily amorphous metal. The layer 402 that has a composition that is amorphous metal and ceramic particles. The layer 403 has a composition that is primarily ceramic particles. The transition at the interface between the substrate and coating enhances bond strength, and accommodates the gradient in shear stress at the interface. The layer is formed from a compliant, ductile metal with high fracture toughness.

There are interfaces between the layers 401, 402, and 403. For example, an interface between the layers 401 and 402 gradually transition from the layer 401 that has a composition that is primarily amorphous metal to the layer 402 that has a composition that is amorphous metal and ceramic particles. An interface between the layers 402 and 403 gradually transition from the layer 402 that has a composition that is primarily ceramic particles to the layer 403 that has a composition that is primarily ceramic particles.

Figure 5:
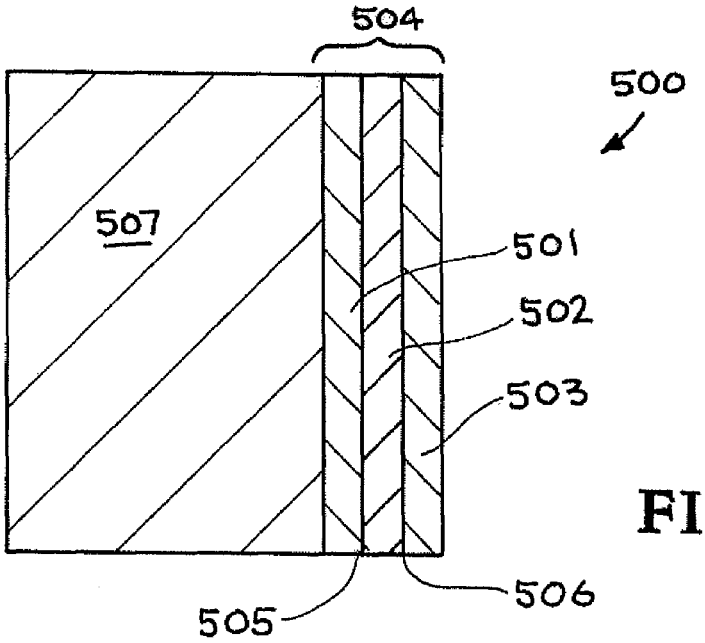
FIG. 5 illustrates yet another embodiment of spray processing that forms alternating layers of a coating wherein the alternate layers comprise amorphous metal and ceramic particles.

Referring again to the drawings and in particular to FIG. 5, another embodiment of the present invention is illustrated. The embodiment illustrates a corrosion resistant amorphous metal-ceramic coating constructed according to the present invention. The corrosion resistant amorphous metal-ceramic coating is designated generally by the reference numeral 504. The overall system of this embodiment of the present invention is designated generally by the reference numeral 500.

The corrosion resistant amorphous metal-ceramic coating 504 is produced by spray processing to form a composite material on a structure 507. The spray processing forms alternating layers of the coating 504 and the alternate layers comprise amorphous metal and ceramic particles. As illustrated in FIG. 5, there are alternate layers 501, 502, and 503. The layer 501 has a composition that is primarily amorphous metal. The layer 502 has a composition that is primarily ceramic particles. The layer 503 has a composition that is primarily amorphous metal.

There are interfaces between the layers 501, 502, and 503. For example, an interface 505 between the layers 501 and 502 gradually transition from the layer 501 that has a composition that is primarily amorphous metal to the layer 502 that has a composition that is primarily ceramic particles. An interface 506 between the layers 502 and 503 gradually transition from the layer 502 that has a composition that is primarily ceramic particles to the layer 503 that has a composition that is primarily amorphous metal.

The alternate layers 501, 502, and 503 provide a coating that is a composite material. The at least one of the layers 501, 502, or 503 is a corrosion resistant amorphous metal-ceramic coating made of amorphous metal and ceramic particles. The composite material has the composition of an iron-based amorphous metal, and is made of the following elements in the specified range of composition: yttrium (≥1 atomic %), chromium (14 to 18 atomic %), molybdenum (≥7 atomic %), tungsten (≥1 atomic %), boron (≤5 atomic %), carbon (≥4 atomic %) and ceramic particles 5 nanometers to 5 microns.

In another embodiment of this invention, alternate layers 501, 502, and 503 provide a coating that is a composite material. The at least one of the layers 501, 502, or 503 is a corrosion resistant amorphous metal-ceramic coating made of amorphous metal and ceramic particles. The composite material has the composition of amorphous metal made of the following elements in any range of composition: yttrium, chromium, molybdenum, tungsten, boron, carbon, and ceramic particles 5 nanometers to 5 microns.

A spray processing forms alternating layers of amorphous metal and ceramic particles. There are interfaces 505 and 506 between the layers 501, 502, and 503. The interfaces 505 and 506 between the layers gradually transition from a composition that is primarily amorphous metal to a composition that is primarily ceramic particles.

Figure 6A:
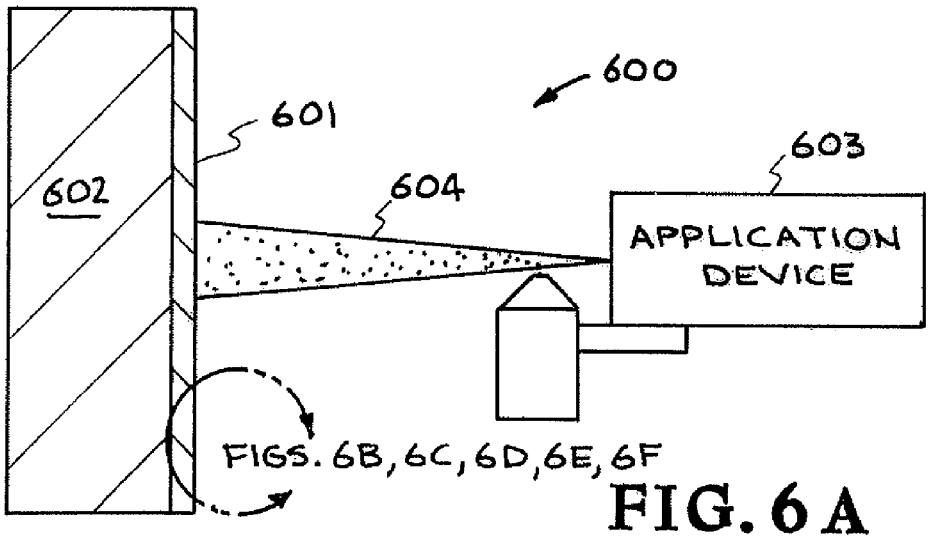
FIGS. 6A through 6F illustrates an embodiment of spray processing that forms a coating comprising metal and particles.

Referring now to FIG. 6A, another embodiment of a system incorporating the present invention is illustrated. This embodiment is designated generally by the reference numeral 600. The coating is formed by spray processing as illustrated in FIG. 6A. Metal and particles are used in a spray process to form a coating 601.

As illustrated in FIG. 6A, metal and particles are applied to a structure 602 to form the coating 601. The coating 601 is applied by a spray or deposition process. A device 603 is applying a spray 604. Different spray or deposition processing systems can be used to form the coating 601; for example, the spray processing can be flame spray processing, plasma spray processing, high-velocity oxy-fuel (HVOF) spray processing, high-velocity air-spray (HVAF) processing, or detonation gun processing. The spray processing can be thermal spray processing or cold spray processing or deposition processing.

The system 600 provides the corrosion resistant coating 601. FIGS. 6B, 6C, 6D, 6E, and 6F show different embodiments of the coating 601 applied by the spray or deposition process 603. The coating 601 is a composite material.

Figure 6B:
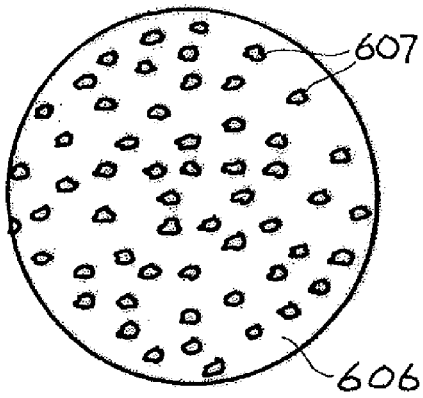

As illustrated in FIG. 6B, the composite material has the composition of amorphous metal 606 and ceramic particles 607. In one embodiment, the amorphous metal 606 is Fe-based, Ni-based, Cu-based, Al-based, or Zr-based amorphous metal. In the case of the Fe-based amorphous metal, the coating 601 has the following composition: yttrium (≥1 atomic %), chromium (14 to 18 atomic %) molybdenum (≥7 atomic %), tungsten (≥1 atomic %), boron (≤5 atomic %), carbon (≥4 atomic %) and ceramic particles in a size range of nanometers to microns. In another embodiment composite material has the composition of amorphous metal 606 and ceramic particles 607. The amorphous metal 606 can be Fe-based, Ni-based, Cu-based, Al-based, or Zr-based amorphous metal. In the case of the iron-based amorphous metal, the amorphous metal contains the following elements at any concentration: yttrium, chromium, molybdenum, tungsten, boron, carbon, and ceramic particles in a size range of nanometers to microns.

Figure 6C:
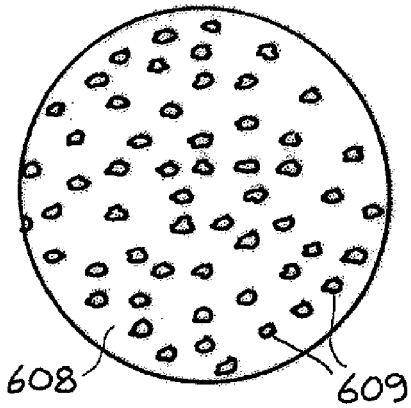

As illustrated in FIG. 6C, the composite material has the composition of a soft metal binder 608 and ceramic particles 609. The composite material is a homogenous mixture of the ceramic particles 609 and the soft metal binder 608. In one embodiment, the soft metal 608 is Fe-based, Ni-based, Cu-based, Al-based, or Zr-based. The ceramic particles 609 have a size range of nanometers to microns.

Figure 6D:
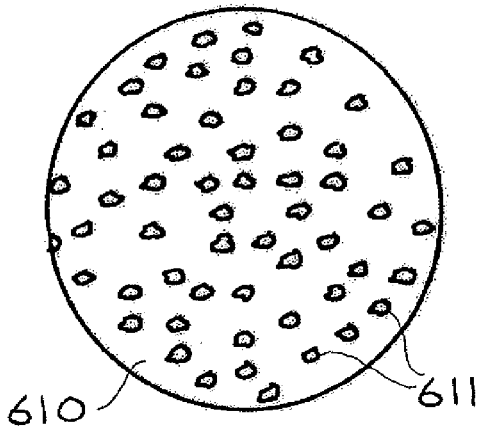

As illustrated in FIG. 6D, the composite material has the composition of a soft metal binder 610 and amorphous metal particles 611. The composite material is a homogenous mixture of the amorphous-meta particles 611 and the soft metal binder 610. In one embodiment, the soft metal 610 is Fe-based, Ni-based, Cu-based, Al-based, or Zr-based. The amorphous metal particles 611 have a size range of nanometers to microns.

Figure 6E:
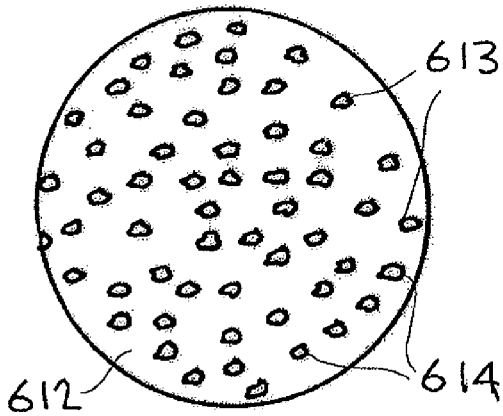

As illustrated in FIG. 6E, the composite material has the composition of a soft metal binder 612, ceramic particles 613, and amorphous metal particles 614. The composite material is a homogenous mixture of the ceramic particles 613, the amorphous metal particles 613, and the soft metal binder 612. In one embodiment, the soft metal 612 is Fe-based, Ni-based, Cu-based, Al-based, or Zr-based. The ceramic particles 613 and the amorphous metal particles 614 have a size range of nanometers to microns.

Figure 6F:
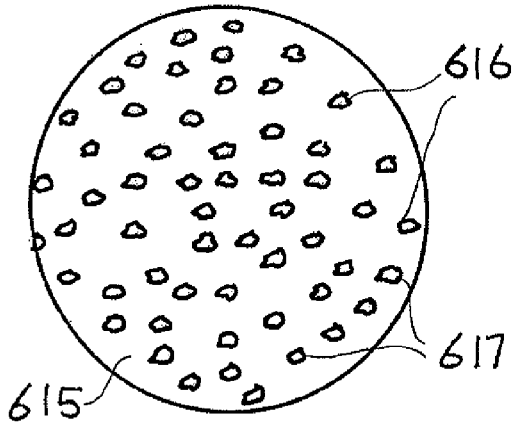

As illustrated in FIG. 6F, the composite material has the composition of an amorphous metal binder 615, ceramic particles 616, and amorphous metal particles 617. The composite material is a homogenous mixture of the ceramic particles 617, the amorphous metal particles 616, and the amorphous metal binder 615. In one embodiment, the amorphous metal 615 is Fe-based, Ni-based, Cu-based, Al-based, or Zr-based. The ceramic particles 617 and the amorphous metal particles 616 have a size range of nanometers to microns.

Corrosion costs the nation billions of dollars every year. There is an immense quantity of material in various structures undergoing corrosion. For example, approximately 345 million square feet of structure aboard naval ships and crafts require costly corrosion control measures. In addition, fluid and seawater piping, ballast tanks, and propulsions systems require costly corrosion control measures. The use of advanced corrosion-resistant materials to prevent the continuous degradation of this massive surface area would be extremely beneficial.

Man-made materials with unusually long service lives are needed for the construction of containers and associated structures for the long-term storage or disposal of spent nuclear fuel (SNF) and high-level waste (HLW) in underground repositories. Man has never designed and constructed any structure or system with the service life required by a SNF and HLW repository. Such systems will be required to contain these radioactive materials for a period as short as 10,000 years, and possibly as long as 300,000 years. The most robust engineering materials known are challenged by such long times. Thus, the ongoing investigation of newer, more advanced materials would be extremely beneficial.

The present invention provides a system for forming a coating comprising the steps of spray processing to form a composite material made of an iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. In another embodiment of the coating the amorphous metal includes the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %). The spray processing is thermal spray processing or cold spray processing.

The present invention also provides a system for forming a coating comprising the steps of spray processing to form a composite material made of amorphous metal that contains one or more of the following elements in any range of composition: yttrium, chromium, molybdenum, tungsten, boron, or carbon and ceramic particles in the range of nanometers to microns. In another embodiment of the coating the iron-based amorphous metal includes the following elements in any range of composition: yttrium, chromium, molybdenum, tungsten, boron, or carbon (no ceramic particles included). The spray processing is thermal spray processing or cold spray processing.

In different embodiments, the spray processing forms alternating layers of amorphous metal and ceramic particles wherein there are interfaces between the layers. In one embodiment the interfaces between the layers gradually transition from a composition that is primarily amorphous metal to a composition that is primarily ceramic particles. In another embodiment the interfaces between the layers that gradually transition from a composition that is primarily ceramic to a composition that is primarily amorphous metal.

There are many uses for the corrosion resistant amorphous metal-ceramic coating of the present invention. For example, the coating has application on ships; oil, gas, and water drilling equipment; earth moving equipment; tunnel-boring machinery; pump impellers and shafts; containers for shipment, storage and disposal of spent nuclear fuel; pressurized water and boiling water nuclear reactors; breeder reactors with liquid metal coolant; metal-ceramic armor; projectiles; gun barrels; tank loader trays; rail guns; non-magnetic hulls; hatches; seals; propellers; rudders; planes; and any other use where corrosion resistance is needed.

The use of the corrosion resistant amorphous metal-ceramic coating of the present invention to prevent the continuous degradation of fluid and seawater contact areas of surfaces including piping, ballast tanks, and propulsions systems, aboard naval ships and crafts would be extremely beneficial. The corrosion resistant amorphous metal-ceramic coating of the present invention can also be used to coat the outer surface of containers for the transportation and long-term storage of high-level radioactive waste (HLW) spent nuclear fuel (SNF), or to protect welds and heat affected zones, thereby preventing exposure to environments that might cause stress corrosion cracking.

Applicants have conducted studies and analysis of systems of the present invention. Examples of systems incorporating the present invention are provided below.

EXAMPLE 1

Example 1 is a specific example of a system incorporating the present invention. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles were used to form the coating.

In Example 1a at least one layer of the coating is formed by the Flame Spray Process (FSP) that uses a combustion flame and characterized by relatively low gas and particle velocities. The at least one layer of the coating produced by the Flame Spray Process is a composite material made of an iron-based amorphous metal that contains one or more of the following elements in the specified range of composition: yttrium (≥1 atomic %), chromium (14 to 18 atomic %) molybdenum (≥7 atomic %), tungsten (≥1 atomic %), boron (≤5 atomic %) or carbon (≥4 atomic %) and ceramic particles in the range of nanometers to microns. The Flame Spray Process is used for the deposition of at least one layer of the coating with desired degrees of residual porosity and crystallinity. The at least one layer of the coating produced by the Flame Spray Process has bond strengths of about 4,000 pounds per square inch, porosities of approximately 5 percent (5%), and micro-hardness of 85 HRB.

In Example 1b at least one layer of the coating is formed by the Flame Spray Process (FSP) that uses a combustion flame and characterized by relatively low gas and particle velocities. The at least one layer of the coating produced by the Flame Spray Process is a composite material made of an iron-based amorphous metal that contains one or more of the following elements in any range of composition: yttrium, chromium, molybdenum, tungsten, boron, or carbon and ceramic particles in the range of nanometers to microns. The Flame Spray Process is used for the deposition of at least one layer of the coating with desired degrees of residual porosity and crystallinity. The at least one layer of the coating produced by the Flame Spray Process has bond strengths of about 4,000 pounds per square inch, porosities of approximately 5 percent (5%), and micro-hardness of 85 HRB.

EXAMPLE 2

Example 2 is another specific example of a system incorporating the present invention. The system provides at least one layer of a corrosion resistant amorphous metal-ceramic coating. The at least one layer of the corrosion resistant amorphous metal-ceramic coating is produced by spray processing to form a composite material made of amorphous metal and ceramic particles. Amorphous metal and ceramic particles are used to form the coating.

In Example 2a the at least one layer of the coating is formed by the Wire Arc Process (WAP) that uses an electrical discharge instead of a combustion flame, and is more energetic than FSP. The at least one layer of the coating produced by the Wire Arc Process is a composite material made of an iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %) or carbon (≥4 atomic %) and ceramic particles in the range of nanometers to microns. The Wire Arc Process is used for the deposition of the at least one layer of the coating with desired degrees of residual porosity and crystallinity. The coating produced by the Wire Arc Process has bond strengths of about 5,800 pounds per square inch, porosities of approximately two percent (2%), and micro-hardness of 55 HRC.

In Example 2a the at least one layer of the coating is formed by the Wire Arc Process (WAP) that uses an electrical discharge instead of a combustion flame, and is more energetic than FSP. The at least one layer of the coating produced by the Wire Arc Process is a composite material made of an iron-based amorphous metal that contains one or more of the following elements in any range of composition: yttrium; chromium, molybdenum, tungsten, boron, or carbon and ceramic particles in the range of nanometers to microns. The Wire Arc Process is used for the deposition of the at least one layer of the coating with desired degrees of residual porosity and crystallinity. The coating produced by the Wire Arc Process has bond strengths of about 5,800 pounds per square inch, porosities of approximately two percent (2%), and micro-hardness of 55 HRC.

EXAMPLE 3

Example 3 is another specific example of a system incorporating the present invention as illustrated by the system. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles are used to form the coating.

In Example 3 the coating is formed by the Plasma Spray Process (PSP) that involves the use of an electric arc with inert gas to create a plasma. Flame temperatures as high as 30,000° C. can be achieved.

The coating produced by the Plasma Spray Process is a composite material made of iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. The Plasma Spray Process is used for the deposition of the coating with desired degrees of residual porosity and crystallinity. The coating produced by the Plasma Spray Process has bond strengths of about 8,000 pounds per square inch, porosities of approximately three percent (3%), and micro-hardness of 90 HRB.

The coating produced by the Plasma Spray Process is a composite material made of an iron-based amorphous metal that contains one or more of the following elements in any range of composition: yttrium, chromium, molybdenum, tungsten, boron, or carbon and ceramic particles in the range of nanometers to microns. The Plasma Spray Process is used for the deposition of the coating with desired degrees of residual porosity and crystallinity. The coating produced by the Plasma Spray Process has bond strengths of about 8,000 pounds per square inch, porosities of approximately three percent (3%), and micro-hardness of 90 HRB.

EXAMPLE 4

Example 4 is another specific example of a system incorporating the present invention as illustrated by the system. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles are used to form the coating.

In Example 4 the coating is formed by the Laser Assisted Plasma Spray Process (LAPSP). The Laser Assisted Plasma Spray Process was developed by Faunhoffer Institute and involves the direct interaction of a high-intensity laser beam with spray particles and the substrate. This process produces metallic coatings with virtually theoretical density and with metallurgical bonding. In regard to the distribution of energy released during the process, ninety to ninety-five percent (90-95%) of the energy is transferred from the plasma torch to the spray powder and used to melt the powder, while five to ten percent (5-10%) of the energy is consumed by the laser and ultimately used to fuse the spray particles and to melt the substrate.

The coating produced by the Plasma Spray Process is a composite material made of an iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. The Laser Assisted Plasma Spray Process (LA PSP) is used for the deposition of the coating with desired degrees of residual porosity and crystallinity.

The coating produced by the Plasma Spray Process is a composite material made of an iron-based amorphous metal that contains one or more of the following elements in any range of composition: yttrium, chromium, molybdenum, tungsten, boron, or carbon and ceramic particles in the range of nanometers to microns. The Laser Assisted Plasma Spray Process (LAPSP) is used for the deposition of the coating with desired degrees of residual porosity and crystallinity.

EXAMPLE 5

Example 5 is another specific example of a system incorporating the present invention as illustrated by the system. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles are used to form the coating.

In Example 5 the coating is formed by the Water Stabilized Plasma Spray Process (WSPSP). The Water Stabilized Plasma Spray Process was recently developed by Caterpillar and provides the capability of spraying at extremely high rates, approaching 200 pounds per hour. This process has already been used for coating large components, such as the Caterpillar Model 3500 Diesel Engine block.

The coating produced by the Water Stabilized Plasma Spray Process is a composite material made of an iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. The Water Stabilized Plasma Spray Process is used for the deposition of the coating with desired degrees of residual porosity and crystallinity.

The coating produced by the Water Stabilized Plasma Spray Process is a composite material made of an iron-based amorphous metal that contains one or more of the following elements in any range of composition: yttrium, chromium, molybdenum, tungsten, boron, or carbon and ceramic particles in the range of nanometers to microns. The Water Stabilized Plasma Spray Process is used for the deposition of the coating with desired degrees of residual porosity and crystallinity.

EXAMPLE 6

Example 6 is another specific example of a system incorporating the present invention as illustrated by the system. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles are used to form the coating.

In Example 6 the coating is formed by the High Velocity Oxy Fuel (HVOF) Process. The High Velocity Oxy Fuel Process involves a combustion flame, and is characterized by gas and particle velocities that are three to four times the speed of sound (mach 3 to 4).

The coating produced by the High Velocity Oxy Fuel Process is a composite material made of an iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. The Water Stabilized Plasma Spray Process is used for the deposition of the coating with desired degrees of residual porosity and crystallinity. The coat produced by the High Velocity Oxy Fuel Process has bond strengths of about 8,600 pounds per square inch, porosities of less than one percent (<1%), and micro-hardness of 68 HRC.

The coating produced by the High Velocity Oxy Fuel Process is a composite material made of an iron-based amorphous metal that contains one or more of the following elements in any range of composition: yttrium, chromium, molybdenum, tungsten, boron, or carbon and ceramic particles in the range of nanometers to microns. The Water Stabilized Plasma Spray Process is used for the deposition of the coating with desired degrees of residual porosity and crystallinity. The coat produced by the High Velocity Oxy Fuel Process has bond strengths of about 8,600 pounds per square inch, porosities of less than one percent (<1%), and micro-hardness of 68 HRC.

EXAMPLE 7

Example 7 is another specific example of a system incorporating the present invention as illustrated by the system. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles are used to form the coating.

In Example 7 the coating is formed by the Detonation Gun Process (DGP). The Detonation Gun Process was developed in Russia, and is based upon the discontinuous detonation of an oxygen-fuel mixture. Very high gas and particle velocities are achieved with this novel process, velocities approaching four to five times the speed of sound (mach 4-5).

The coating produced by the Detonation Gun Process is a composite material made of an iron-based amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. The Water Stabilized Plasma Spray Process is used for the deposition of the coating with desired degrees of residual porosity and crystallinity. The coating produced by the Detonation Gun Process has exceptional bond strengths, in excess of 10,000 pounds per square inch, porosities of less than one-half of one percent (<0.5%), and micro-hardness of 68 HRC.

The coating produced by the Detonation Gun Process is a composite material made of an iron-based amorphous metal that contains one or more of the following elements in any range of composition: yttrium, chromium, molybdenum, tungsten, boron, or carbon and ceramic particles in the range of nanometers to microns. The Water Stabilized Plasma Spray Process is used for the deposition of the coating with desired degrees of residual porosity and crystallinity. The coating produced by the Detonation Gun Process has exceptional bond strengths, in excess of 10,000 pounds per square inch, porosities of less than one-half of one percent (<0.5%), and micro-hardness of 68 HRC.

EXAMPLE 8

Other Processes

Example 8 is another specific example of systems incorporating the present invention as illustrated by the system. The system provides a corrosion resistant amorphous metal-ceramic coating. The corrosion resistant amorphous metal-ceramic coating is produced by spray processing to form a composite material made of amorphous metal and ceramic particles. Amorphous metal and ceramic particles are used to form the coating.

In the other Examples 8 the coating is formed by processes including HP HVOF, LA PSP, WS PSP, and DGP, and promise the advantages of fully dense coatings, improved bonding to substrates, and high rates of deposition. High-density infrared fusing with high-intensity lamps, a process developed by ORNL, may be used for postdeposition porosity and bonding control, provided that amorphous metals with sufficiently low critical cooling rates (CCRs) can be found.

The coating produced by the other Examples 8 is a composite material made of amorphous metal that contains one or more of the following elements in the specified range of composition: yttrium (≥1 atomic %), chromium (14 to 18 atomic %), molybdenum (≥7 atomic %), tungsten (≥1 atomic %), boron (≤5 atomic %), or carbon (≥4 atomic %) and ceramic particles in the range of nanometers to microns. The Water Stabilized Plasma Spray Process is used for the deposition of the coating with desired degrees of residual porosity and crystallinity.

The coating produced by the other Examples 8 is a composite material made of amorphous metal that contains one or more of the following elements in any range of composition: yttrium, chromium, molybdenum, tungsten, boron, or carbon and ceramic particles in the range of nanometers to microns. The Water Stabilized Plasma Spray Process is used for the deposition of the coating with desired degrees of residual porosity and crystallinity.

In other embodiments, the spray processing includes spray processing additional ingredients for the purpose of enhancing lubricity. For example, in one embodiment the spray processing includes spray processing graphite for the purpose of enhancing lubricity. In another embodiment, the spray processing includes spray processing fluorinated polymers for the purpose of enhancing lubricity.

In other embodiments, the spray processing includes dispersing the ceramic particles in the amorphous metal in situ through controlled thermally-driven internal oxidation or precipitation reaction. In other embodiments, the spray processing includes dispersing the ceramic particles in the amorphous metal in situ through controlled thermally-driven internal oxidation or precipitation reaction by heating from a thermal spray process. In other embodiments, the spray processing includes dispersing the ceramic particles in the amorphous metal in situ through controlled thermally-driven internal oxidation or precipitation reaction by heating from a high-intensity lamp. In other embodiments, the spray processing includes dispersing the ceramic particles in the amorphous metal in situ through controlled thermally-driven internal oxidation or precipitation reaction by heating from a laser. In other embodiments, the spray processing includes dispersing the ceramic particles in the amorphous metal in situ through controlled thermally-driven internal oxidation or precipitation reaction by heating from electrical resistance heating. In other embodiments, the spray processing includes dispersing the ceramic particles in the amorphous metal in situ through controlled thermally-driven internal oxidation or precipitation reaction by heating from a localized induction heating. In other embodiments, the spray processing includes dispersing the ceramic particles in the amorphous metal in situ through controlled thermally-driven internal oxidation or precipitation reaction by heating from a localized exothermic chemical reaction.

The system of forming a coating of the present invention includes the steps of using particle-size optimization to ensure that the amorphous metal particles are small enough to ensure that a critical cooling rate is achieved throughout the amorphous metal enabling the achievement of a fully dense metal-ceramic composite coating. For example, the present invention includes the steps of using particle-size optimization using small enough amorphous metal powder in a mixed metal-ceramic feed to ensure that the critical cooling rate is achieved throughout the amorphous metal, even in cases where the critical cooling rate may be relatively high (≥1000 K per second).

The system of forming a coating of the present invention includes the steps of post-spray high-density infrared fusing to achieve lower porosity and higher density, thereby enhancing corrosion resistance and damage tolerance of the coating. The system of forming a coating of the present invention includes the steps of post-spray high-density infrared fusing to achieve enhanced metallurgical bonding and to control damage tolerance through controlled devitrification of the amorphous metal.

In other embodiments, the system of forming a coating of the present invention utilizes ceramic particles having diameters in the range of nanometers to microns are used in the step of spray processing. For example, the system of forming a coating of the present invention utilizes ceramic particles having diameters in the range of five nanometers to five microns are used in the step of spray processing.

In other embodiments the system of forming a coating of the present invention, the ceramic particles used in the step of spray processing are produced by reverse micelle synthesis.

EXAMPLE 9

Example 9 is another specific example of a system incorporating the present invention as illustrated by the system. The system provides a corrosion resistant amorphous metal-ceramic coating. The coating produced is a composite material. The composite material has the composition shown in Table 1. The corrosion resistant amorphous metal-ceramic coating is produced by spray processing to form a composite material made of amorphous metal and ceramic particles. In other embodiments, the amorphous metal is Fe-based, Ni-based, Cu-based, Al-based, or Zr-based amorphous metal.

TABLE 1

| (Contains the elements in the specified range of composition) | |
|---|---|
| Iron-Based Amorphous Metal | Ceramic Particles |
| yttrium (≥1 atomic %)<br>chromium (14 to 18 atomic %)<br>molybdenum (≥7 atomic %)<br>tungsten (≥1 atomic %)<br>boron (≤5 atomic %)<br>carbon (≥4 atomic %) | nanometers to microns |

EXAMPLE 10

Example 10 is another specific example of a system incorporating the present invention as illustrated by the system. The system provides a corrosion resistant amorphous metal-ceramic coating. The coating produced is a composite material. The composite material has the composition shown in Table 2. The corrosion resistant amorphous metal-ceramic coating is produced by spray processing to form a composite material made of amorphous metal and ceramic particles.

TABLE 2

| (Contains the elements in the specified range of composition) | |
|---|---|
| Iron-Based Amorphous Metal | Ceramic Particles |
| yttrium (≥1 atomic %)<br>chromium (14 to 18 atomic %) | 5 nanometers to 5 microns |

TABLE 2-continued

| (Contains the elements in the specified range of composition) | |
|---|---|
| Iron-Based Amorphous Metal | Ceramic Particles |
| molybdenum (≥7 atomic %)<br>tungsten (≥1 atomic %)<br>boron (≤5 atomic %)<br>carbon (≥4 atomic %) | |

In different embodiments of a system incorporating the present invention the spray processing forms alternating layers of amorphous metal and ceramic particles. There are interfaces between the layers. In one embodiment the interfaces between the layers gradually transition from a composition that is primarily amorphous metal to a composition that is primarily ceramic particles. In another embodiment the interfaces between the layers that gradually transition from a composition that is primarily ceramic to a composition that is primarily amorphous metal.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

The invention claimed is:

1. A method of coating a surface, said method comprising the steps of:

feeding a first set of amorphous metal particles from a first source, wherein the composition of said first set of amorphous metal particles is an Fe-based alloy, Ni-based alloy, Cu-based alloy, Al-based alloy, or Zr-based alloy, further alloyed with each of the following elements in the specified range of composition: yttrium≥1 atomic %, chromium 14 to 18 atomic %, molybdenum≥7 atomic %, tungsten≥1 atomic %, boron≤5 atomic %, and carbon≥4 atomic %;

feeding a mixture of ceramic particles and second set of amorphous metal particles, wherein said mixture is fed from a second source, wherein the composition of said ceramic particles is an oxide, carbide, boride, or nitride, and wherein said the particle size of said ceramic particles is within the range of 5 nanometers to 5 microns;

combining the said fed first set of amorphous metal particles and said fed mixture, to form a combined mixture;

feeding said combined mixture into a spray deposition device; and, applying said combined mixture to the surface by a spray process, thereby coating the surface with a coating of a homogenously mixed composite material made of said first set of amorphous metal particles, said second set of amorphous metal particles, and said ceramic particles.

2. The method of coating a surface of claim 1 wherein said spray process is a cold spray process.

3. The method of coating a surface of claim 1 wherein said spray process is a thermal spray process.

4. The method of coating a surface of claim 1 wherein said spray process is a flame spray process.

5. The method of coating a surface of claim 1 wherein said spray process is a high-velocity spray process.

* * * * *